US009519251B2

(12) United States Patent
Imada et al.

(10) Patent No.: US 9,519,251 B2
(45) Date of Patent: Dec. 13, 2016

(54) FIXING DEVICE AND IMAGE FORMING APPARATUS COMPRISING A MULTILAYERED TWILL FABRIC SLIDE SHEET

(71) Applicants: Takahiro Imada, Kanagawa (JP); Yuji Arai, Kanagawa (JP); Takuya Seshita, Kanagawa (JP); Motoyoshi Yamano, Kanagawa (JP); Hajime Gotoh, Kanagawa (JP); Akira Suzuki, Tokyo (JP)

(72) Inventors: Takahiro Imada, Kanagawa (JP); Yuji Arai, Kanagawa (JP); Takuya Seshita, Kanagawa (JP); Motoyoshi Yamano, Kanagawa (JP); Hajime Gotoh, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/069,492

(22) Filed: Mar. 14, 2016

(65) Prior Publication Data

US 2016/0274515 A1 Sep. 22, 2016

(30) Foreign Application Priority Data

Mar. 18, 2015 (JP) ..... 2015-054962

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2075; G03G 15/2085; G03G 2215/2035
See application file for complete search history.

(56) References Cited

U.S. PATENT DOCUMENTS

2005/0147436 A1* 7/2005 Koyama ..... G03G 15/206 399/329
2009/0014942 A1* 1/2009 Okuno ..... G03G 15/2053 271/4.06

(Continued)

FOREIGN PATENT DOCUMENTS

JP 2013-152268 8/2013
JP 2013-174629 9/2013

(Continued)

*Primary Examiner* — Billy Lactaoen
*Assistant Examiner* — Arlene Heredia Ocasio
(74) *Attorney, Agent, or Firm* — Duft Bornsen & Fettig LLP

(57) ABSTRACT

A fixing device includes an endless belt rotatable in a predetermined direction of rotation and a nip formation pad disposed opposite an inner circumferential surface of the endless belt. A slide sheet is sandwiched between the nip formation pad and the endless belt and is a twill fabric containing a lubricant. The slide sheet includes a first sheet contacting the nip formation pad and including a first gutter defined by a first twill line in a first direction angled relative to the direction of rotation of the endless belt and a second sheet layered on the first sheet and contacting the endless belt. The second sheet includes a second gutter defined by a second twill line in a second direction angled relative to the direction of rotation of the endless belt.

20 Claims, 5 Drawing Sheets

(56) References Cited

U.S. PATENT DOCUMENTS

| | | | | |
|---|---|---|---|---|
| 2010/0202809 | A1* | 8/2010 | Shinshi | G03G 15/2064 399/329 |
| 2013/0189008 | A1 | 7/2013 | Ishii et al. | |
| 2013/0195523 | A1 | 8/2013 | Yamaji et al. | |
| 2013/0195524 | A1 | 8/2013 | Ishii et al. | |
| 2014/0064804 | A1 | 3/2014 | Yamaguchi et al. | |
| 2014/0241766 | A1 | 8/2014 | Ishii et al. | |
| 2015/0261155 | A1 | 9/2015 | Yoshiura et al. | |

FOREIGN PATENT DOCUMENTS

| | | |
|---|---|---|
| JP | 2014-081399 | 5/2014 |
| JP | 2014-164245 | 9/2014 |
| JP | 2014-174358 | 9/2014 |
| JP | 2014-186303 | 10/2014 |

* cited by examiner

FIXING DEVICE AND IMAGE FORMING APPARATUS COMPRISING A MULTILAYERED TWILL FABRIC SLIDE SHEET

CROSS-REFERENCE TO RELATED APPLICATION

This patent application is based on and claims priority pursuant to 35 U.S.C. §119 to Japanese Patent Application No. 2015-054962, filed on Mar. 18, 2015, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes an endless belt rotatable in a predetermined direction of rotation and a nip formation pad disposed opposite an inner circumferential surface of the endless belt. A pressure rotator presses against the nip formation pad via the endless belt to form a fixing nip between the endless belt and the pressure rotator, through which a recording medium bearing a toner image is conveyed. A slide sheet is sandwiched between the nip formation pad and the endless belt and is a twill fabric containing a lubricant. The slide sheet includes a first sheet contacting the nip formation pad and including a first gutter defined by a first twill line in a first direction angled relative to the direction of rotation of the endless belt and a second sheet layered on the first sheet and contacting the endless belt. The second sheet includes a second gutter defined by a second twill line in a second direction angled relative to the direction of rotation of the endless belt.

This specification further describes an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes an endless belt rotatable in a predetermined direction of rotation and a nip formation pad disposed opposite an inner circumferential surface of the endless belt. A pressure rotator presses against the nip formation pad via the endless belt to form a fixing nip between the endless belt and the pressure rotator, through which the recording medium bearing the toner image is conveyed. A slide sheet is sandwiched between the nip formation pad and the endless belt and is a twill fabric containing a lubricant. The slide sheet includes a first sheet contacting the nip formation pad and including a first gutter defined by a first twill line in a first direction angled relative to the direction of rotation of the endless belt and a second sheet layered on the first sheet and contacting the endless belt. The second sheet includes a second gutter defined by a second twill line in a second direction angled relative to the direction of rotation of the endless belt.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
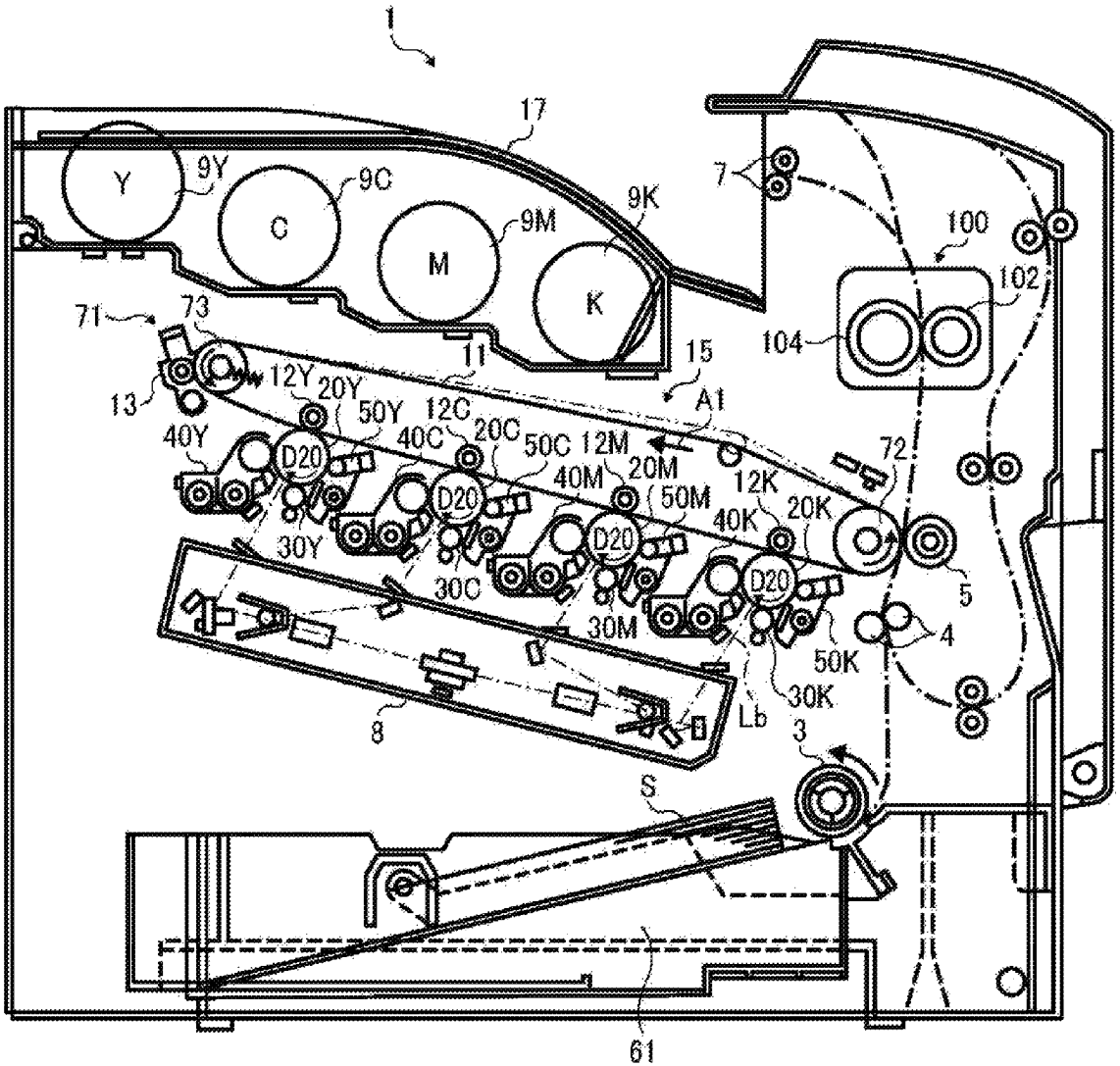
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on recording media by electrophotography. Alternatively, the image forming apparatus 1 may be a monochrome printer that forms a monochrome toner image on a recording medium.

Referring to FIG. 1, a description is provided of a construction of the image forming apparatus 1 and an image forming operation performed by the image forming apparatus 1.

The image forming apparatus 1 is a color printer employing a tandem system in which a plurality of image forming devices for forming toner images in a plurality of colors, respectively, is aligned in a rotation direction of a transfer belt. Alternatively, the image forming apparatus 1 may employ other systems and may be a copier, a facsimile machine, a printer, a multifunction peripheral or a multifunction printer (MFP) having at least one of copying, printing, scanning, facsimile, and plotter functions, or the like.

The image forming apparatus 1 forms yellow, cyan, magenta, and black toner images in separation colors, respectively. Hence, the image forming apparatus 1 employs a tandem structure in which four photoconductive drums 20Y, 20C, 20M, and 20K serving as image bearers that bear yellow, cyan, magenta, and black toner images in separation colors, respectively, are aligned.

Visible images, that is, the yellow, cyan, magenta, and black toner images formed on the photoconductive drums 20Y, 20C, 20M, and 20K, respectively, are primarily transferred successively onto an endless transfer belt 11 serving as an intermediate transferor disposed opposite the photoconductive drums 20Y, 20C, 20M, and 20K as the transfer belt 11 rotates in a rotation direction A1 such that the yellow, cyan, magenta, and black toner images are superimposed on a same position on the transfer belt 11 in a primary transfer process. Thereafter, the yellow, cyan, magenta, and black toner images superimposed on the transfer belt 11 are secondarily transferred onto a sheet S serving as a recording medium collectively in a secondary transfer process. Thus, a color toner image is formed on the sheet S.

Each of the photoconductive drums 20Y, 20C, 20M, and 20K is surrounded by image forming components that form the yellow, cyan, magenta, and black toner images on the photoconductive drums 20Y, 20C, 20M, and 20K as the photoconductive drums 20Y, 20C, 20M, and 20K rotate clockwise in FIG. 1 in a rotation direction D20.

Taking the photoconductive drum 20K that forms the black toner image, the following describes an image forming operation to form the black toner image. The photoconductive drum 20K is surrounded by a charger 30K, a developing device 40K, a primary transfer roller 12K, and a cleaner 50K in this order in the rotation direction D20 of the photoconductive drum 20K. Similarly, the photoconductive drums 20Y, 20C, and 20M are surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. After the charger 30K charges the photoconductive drum 20K, an optical writing device 8 writes an electrostatic latent image on the photoconductive drum 20K.

As the transfer belt 11 rotates in the rotation direction A1, the yellow, cyan, magenta, and black toner images formed on the photoconductive drums 20Y, 20C, 20M, and 20K, respectively, are primarily transferred successively onto the transfer belt 11, thus being superimposed on the same position on the transfer belt 11. In the primary transfer process, the primary transfer rollers 12Y, 12C, 12M, and 12K disposed opposite the photoconductive drums 20Y, 20C, 20M, and 20K via the transfer belt 11, respectively, apply a primary transfer bias to the photoconductive drums 20Y, 20C, 20M, and 20K successively from the upstream photoconductive drum 20Y to the downstream photoconductive drum 20K in the rotation direction A1 of the transfer belt 11.

The photoconductive drums 20Y, 20C, 20M, and 20K are aligned in this order in the rotation direction A1 of the transfer belt 11. The photoconductive drums 20Y, 20C, 20M, and 20K are located in four image forming stations that form the yellow, cyan, magenta, and black toner images, respectively.

The image forming apparatus 1 includes the four image forming stations that form the yellow, cyan, magenta, and black toner images, respectively, a transfer belt unit 15, a secondary transfer roller 5, a transfer belt cleaner 13, and the optical writing device 8. The transfer belt unit 15 is situated above and disposed opposite the photoconductive drums 20Y, 20C, 20M, and 20K. The transfer belt unit 15 incorporates the transfer belt 11 and the primary transfer rollers 12Y, 12C, 12M, and 12K. The secondary transfer roller 5 serves as a secondary transferor disposed opposite the transfer belt 11 and driven and rotated in accordance with rotation of the transfer belt 11. The transfer belt cleaner 13 is disposed opposite the transfer belt 11 to clean the transfer belt 11. The optical writing device 8 is situated below and disposed opposite the four image forming stations.

The optical writing device 8 includes a semiconductor laser serving as a light source, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20K thereon, forming electrostatic latent images on the photoconductive drums 20Y, 20C, 20M, and 20K, respectively. FIG. 1 illustrates the light beam Lb irradiating the photoconductive drum 20K. Similarly, light beams Lb irradiate the photoconductive drums 20Y, 20C, and 20M, respectively.

The image forming apparatus 1 further includes a sheet feeder 61 and a registration roller pair 4 (e.g., a timing roller pair). The sheet feeder 61 incorporates a paper tray that loads a plurality of sheets S to be conveyed to a secondary transfer nip formed between the transfer belt 11 and the secondary transfer roller 5. The registration roller pair 4 conveys a sheet S conveyed from the sheet feeder 61 to the secondary transfer nip formed between the transfer belt 11 and the secondary transfer roller 5 at a predetermined time when the yellow, cyan, magenta, and black toner images superimposed on the transfer belt 11 reach the secondary transfer nip. The image forming apparatus 1 further includes a sensor that detects a leading edge of the sheet S as the sheet S reaches the registration roller pair 4.

The image forming apparatus 1 further includes a fixing device 100, an output roller pair 7, an output tray 17, and toner bottles 9Y, 9C, 9M, and 9K. The fixing device 100 employing a quick start-up (QSU) system that fixes the color toner image formed by the yellow, cyan, magenta, and black toner images secondarily transferred from the transfer belt 11 onto the sheet S thereon. The output roller pair 7 ejects the sheet S bearing the fixed color toner image onto an outside of the image forming apparatus 1, that is, the output tray 17. The output tray 17 is disposed atop the image forming apparatus 1 and stacks the sheet S ejected by the output roller pair 7. The toner bottles 9Y, 9C, 9M, and 9K are situated below the output tray 17 and replenished with fresh yellow, cyan, magenta, and black toners, respectively.

The fixing device 100 includes a pressure roller 102 serving as a pressure rotator or a pressure member and a fixing belt 104, that is, a flexible endless belt serving as a fixing rotator or a fixing member. As the sheet S bearing the unfixed color toner image is conveyed through a fixing nip formed between the fixing belt 104 and the pressure roller 102, the fixing belt 104 and the pressure roller 102 fix the color toner image on the sheet S under heat and pressure. A detailed description of a construction of the fixing device 100 is deferred.

The transfer belt unit 15 includes a driving roller 72 and a driven roller 73 over which the transfer belt 11 is looped, in addition to the transfer belt 11 and the primary transfer rollers 12Y, 12C, 12M, and 12K.

Since the driven roller 73 also serves as a tension applicator that applies tension to the transfer belt 11, a biasing member (e.g., a spring) biases the driven roller 73 against the transfer belt 11. The transfer belt unit 15 incorporating the transfer belt 11 and the primary transfer rollers 12Y, 12C, 12M, and 12K, the secondary transfer roller 5, and the transfer belt cleaner 13 constitute a transfer device 71.

The sheet feeder 61 is situated in a lower portion of the image forming apparatus 1. The sheet feeder 61 includes a feed roller 3 that contacts an upper side of an uppermost sheet S of the plurality of sheets S loaded on the paper tray of the sheet feeder 61. As the feed roller 3 is driven and rotated counterclockwise in FIG. 1, the feed roller 3 feeds the uppermost sheet S to the registration roller pair 4.

The transfer belt cleaner 13 of the transfer device 71 includes a cleaning brush and a cleaning blade being disposed opposite and contacting the transfer belt 11. The cleaning brush and the cleaning blade scrape a foreign substance such as residual toner particles off the transfer belt 11, removing the foreign substance from the transfer belt 11 and thereby cleaning the transfer belt 11.

The transfer belt cleaner 13 further includes a waste toner conveyer that conveys the residual toner particles removed from the transfer belt 11.

Figure 2:
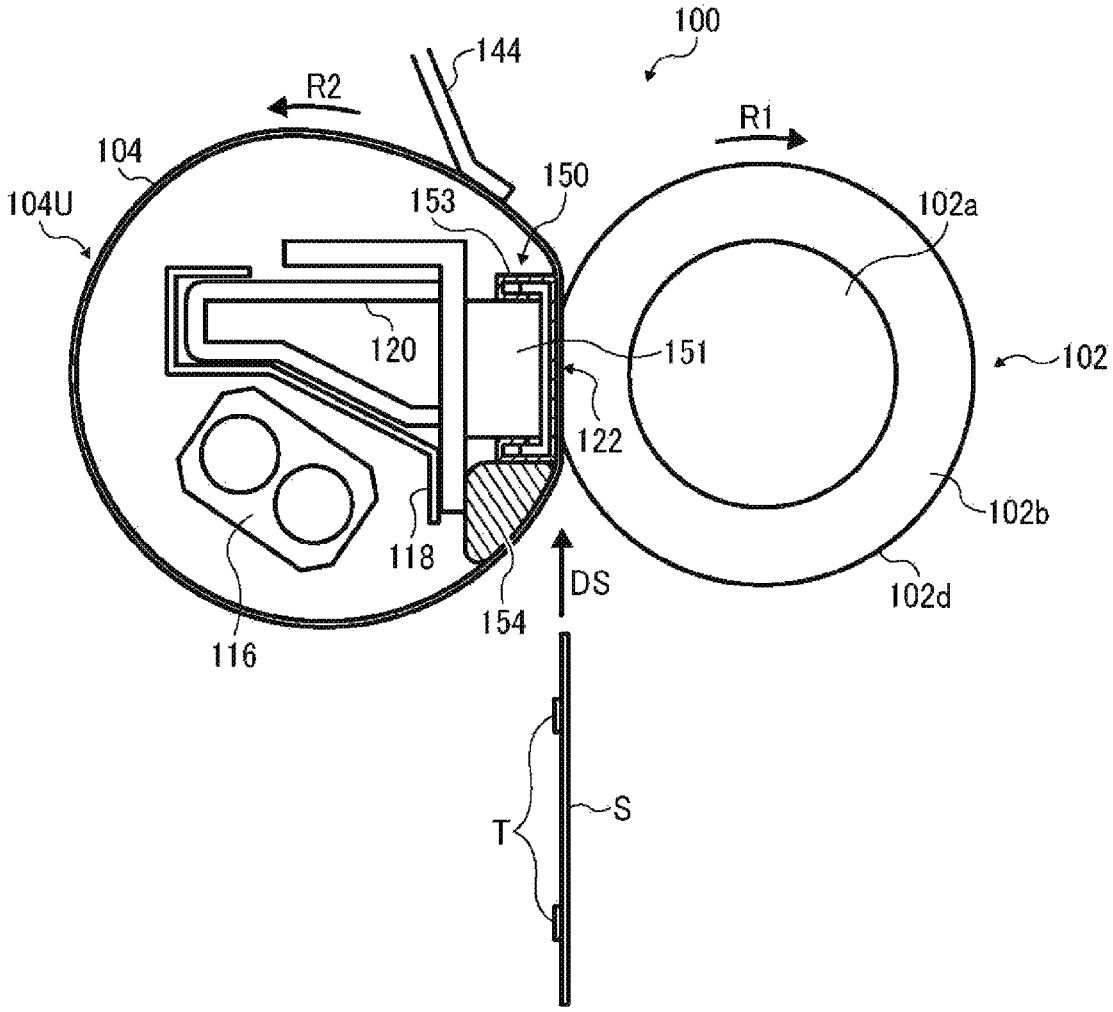
FIG. 2 is a schematic vertical cross-sectional view of a fixing device incorporated in the image forming apparatus illustrated in FIG. 1.

Referring to FIG. 2, a description is provided of a construction and an operation of the fixing device 100 incorporated in the image forming apparatus 1 having the construction described above.

As illustrated in FIG. 2, the fixing device 100 (e.g., a fuser or a fusing unit) includes the pressure roller 102, the fixing belt 104 formed into a loop, a halogen heater pair 116, a nip formation pad 150 incorporating a holder 51, a slide sheet 153, a stay 120, a reflector 118, and a lubricant circulator 154. The halogen heater pair 116 serving as a heater or a heat source is disposed inside the loop formed by the fixing belt 104 to heat the fixing belt 104 directly with light irradiating an inner circumferential surface of the fixing belt 104. The fixing belt 104 and the components disposed inside the fixing belt 104, that is, the halogen heater pair 116, the nip formation pad 150, the slide sheet 153, the stay 120, the reflector 118, and the lubricant circulator 154, may constitute a belt unit 104U separably coupled with the pressure roller 102.

The pressure roller 102 is pressed against the nip formation pad 150 via the fixing belt 104 to form a fixing nip 122 between the fixing belt 104 and the pressure roller 102. As the pressure roller 102 rotates in a rotation direction R1, the fixing belt 104 rotates in a rotation direction R2 in accordance with rotation of the pressure roller 102. The inner circumferential surface of the fixing belt 104 slides over the nip formation pad 150 via the slide sheet 153 coating a surface of the nip formation pad 150. As a sheet S bearing a toner image T conveyed in a sheet conveyance direction DS to the fixing device 100 passes through the fixing nip 122, the fixing belt 104 and the pressure roller 102 fix the toner image T on the sheet S under heat and pressure. Thereafter, the sheet S bearing the fixed toner image T is ejected from the fixing device 100.

As illustrated in FIG. 2, the fixing nip 122 is planar. Alternatively, the fixing nip 122 may be contoured into a recess or other shapes. If the fixing nip 122 defines the recess in the fixing belt 104, the recessed fixing nip 122 directs the leading edge of the sheet S toward the pressure roller 102 as the sheet S is ejected from the fixing nip 122, facilitating separation of the sheet S from the fixing belt 104 and suppressing jamming of the sheet S. A separation plate 144 disposed downstream from the fixing nip 122 in the sheet conveyance direction DS contacts an outer circumferential surface of the fixing belt 104 to separate the sheet S from the fixing belt 104.

A detailed description is now given of a construction of the fixing belt 104.

The fixing belt 104 is an endless belt or film made of metal such as nickel and SUS stainless steel or resin such as polyimide. The fixing belt 104 is constructed of a base layer and a release layer. The release layer constituting an outer surface layer is made of fluoro resin such as tetrafluoroethylene-perfluoroalkylvinylether copolymer (PFA) and polytetrafluoroethylene (PTFE) to facilitate separation of toner of the toner image T on the sheet S from the fixing belt 104. An elastic layer, made of silicone rubber or the like, may be sandwiched between the base layer and the release layer.

If the fixing belt 104 does not incorporate the elastic layer, the fixing belt 104 has a decreased thermal capacity that improves fixing property of being heated quickly to a desired fixing temperature at which the toner image T is fixed on the sheet S. However, as the pressure roller 102 and the fixing belt 104 sandwich and press the toner image T on the sheet S passing through the fixing nip 122, slight surface asperities of the fixing belt 104 may be transferred onto the toner image T on the sheet S, resulting in variation in gloss of the solid toner image T that may appear as an orange peel image on the sheet S. To address this circumstance, the elastic layer made of silicone rubber has a thickness not smaller than 100 micrometers. As the elastic layer deforms, the elastic layer absorbs slight surface asperities of the fixing belt 104, preventing formation of the faulty orange peel image. Instead of metal and polyimide, the base layer of the fixing belt 104 may be made of heat resistant resin such as fluoro resin, polyamide, polyamide imide, polyether ether ketone (PEEK), polyether sulfone (PES), and polyphenylene sulfide (PPS).

A detailed description is now given of a configuration of the stay 120.

The stay 120 situated inside the loop formed by the fixing belt 104 serves as a support that supports the nip formation pad 150 to form the fixing nip 122. As the nip formation pad 150 receives pressure from the pressure roller 102, the stay 120 supports the nip formation pad 150 to prevent bending of the nip formation pad 150. Thus, the stay 120 allows the nip formation pad 150 to produce an even nip length in the sheet conveyance direction DS throughout the entire width of the fixing belt 104 in an axial direction thereof.

The stay 120 is mounted on and held by a pair of flanges at both lateral ends of the stay 120 in a longitudinal direction thereof parallel to the axial direction of the fixing belt 104, respectively, thus being positioned inside the fixing device 100. The reflector 118 interposed between the halogen heater pair 116 and the stay 120 reflects light radiated from the halogen heater pair 116 to the reflector 118 toward the fixing belt 104, preventing the stay 120 from being heated by the halogen heater pair 116 with radiation heat and the like and thereby reducing waste of energy. Alternatively, instead of the reflector 118, an opposed face of the stay 120 disposed opposite the halogen heater pair 116 may be treated with insulation or mirror finish to reflect light radiated from the halogen heater pair 116 to the stay 118 toward the fixing belt 104.

Instead of the halogen heater pair 116, an induction heater, a resistive heat generator, a carbon heater, or the like may be employed as a heater that heats the fixing belt 104. The fixing device 100 illustrated in FIG. 2 includes two halogen heaters constituting the halogen heater pair 116 serving as a heater. Alternatively, the fixing device 100 may include a single halogen heater, three or more halogen heaters, or one or more heaters of other types by considering an appropriate amount of heat conducted to the fixing belt 104.

A detailed description is now given of a construction of the pressure roller 102.

The pressure roller 102 is constructed of a cored bar 102*a*, an elastic rubber layer 102*b* coating the cored bar 102*a*, and a surface release layer 102*d* coating the elastic rubber layer 102*b* and being made of PFA or PTFE to facilitate separation of the sheet S from the pressure roller 102. As a driving force generated by a driver (e.g., a motor) situated inside the image forming apparatus 1 depicted in FIG. 1 is transmitted to the pressure roller 102 through a gear train, the pressure roller 102 rotates in the rotation direction R1 as illustrated in FIG. 2. Alternatively, the driver may also be connected to the fixing belt 104 to drive and rotate the fixing belt 104.

A spring or the like presses the pressure roller 102 against the nip formation pad 150 via the fixing belt 104. As the spring presses and deforms the elastic rubber layer 102*b* of the pressure roller 102, the pressure roller 102 produces the fixing nip 122 having a predetermined length in the sheet conveyance direction DS. The pressure roller 102 may be a hollow roller or a solid roller. If the pressure roller 102 is a hollow roller, a heater such as a halogen heater may be disposed inside the hollow roller.

The elastic rubber layer 102*b* may be made of solid rubber. Alternatively, if no heater is situated inside the pressure roller 102, the elastic rubber layer 102*b* may be made of sponge rubber. The sponge rubber is more preferable than the solid rubber because the sponge rubber has an increased insulation that draws less heat from the fixing belt 104.

As the pressure roller 102 rotates in the rotation direction R1, the fixing belt 104 rotates in the rotation direction R2 in accordance with rotation of the pressure roller 102 by friction therebetween. As illustrated in FIG. 2, as the driver drives and rotates the pressure roller 102 in the rotation direction R1, a driving force of the driver is transmitted from the pressure roller 102 to the fixing belt 104 at the fixing nip 122, thus rotating the fixing belt 104 in the rotation direction R2. At the fixing nip 122, the fixing belt 104 rotates as the fixing belt 104 is sandwiched between the pressure roller 102 and the nip formation pad 150; at a circumferential span of the fixing belt 104 other than the fixing nip 122, the fixing belt 104 rotates as the fixing belt 104 is guided by the flange at each lateral end of the fixing belt 104 in the axial direction thereof.

A detailed description is now given of a configuration of the lubricant circulator 154.

The lubricant circulator 154 is disposed opposite the inner circumferential surface of the fixing belt 104 and disposed upstream from the fixing nip 122 in the sheet conveyance direction DS. The lubricant circulator 154 absorbs a lubricant from the fixing belt 104 and applies the lubricant to the fixing belt 104 again. The lubricant circulator 154 includes a heat resistant, oily sheet wound round in multiple layers and impregnated with a lubricant such as silicone oil.

The lubricant circulator 154 is made of fiber of fluoro resin such as PFA and PTFE like the slide sheet 153 described below or a non-woven fabric made of felt or the like. If the lubricant circulator 154 is made of a fiber sheet, the fiber sheet is wound round in multiple layers into a roll of fabric to increase the size or the volume of the lubricant circulator 154 according to the size of a space available inside the loop formed by the fixing belt 104 so as to enhance retention of the lubricant by the lubricant circulator 154. A biasing member (e.g., a flat spring) presses the lubricant circulator 154 against the fixing belt 104. Alternatively, resilience of fiber or felt of the lubricant circulator 154 may press the lubricant circulator 154 against the fixing belt 104.

A detailed description is now given of a configuration of the holder 151 of the nip formation pad 150.

Figure 3:
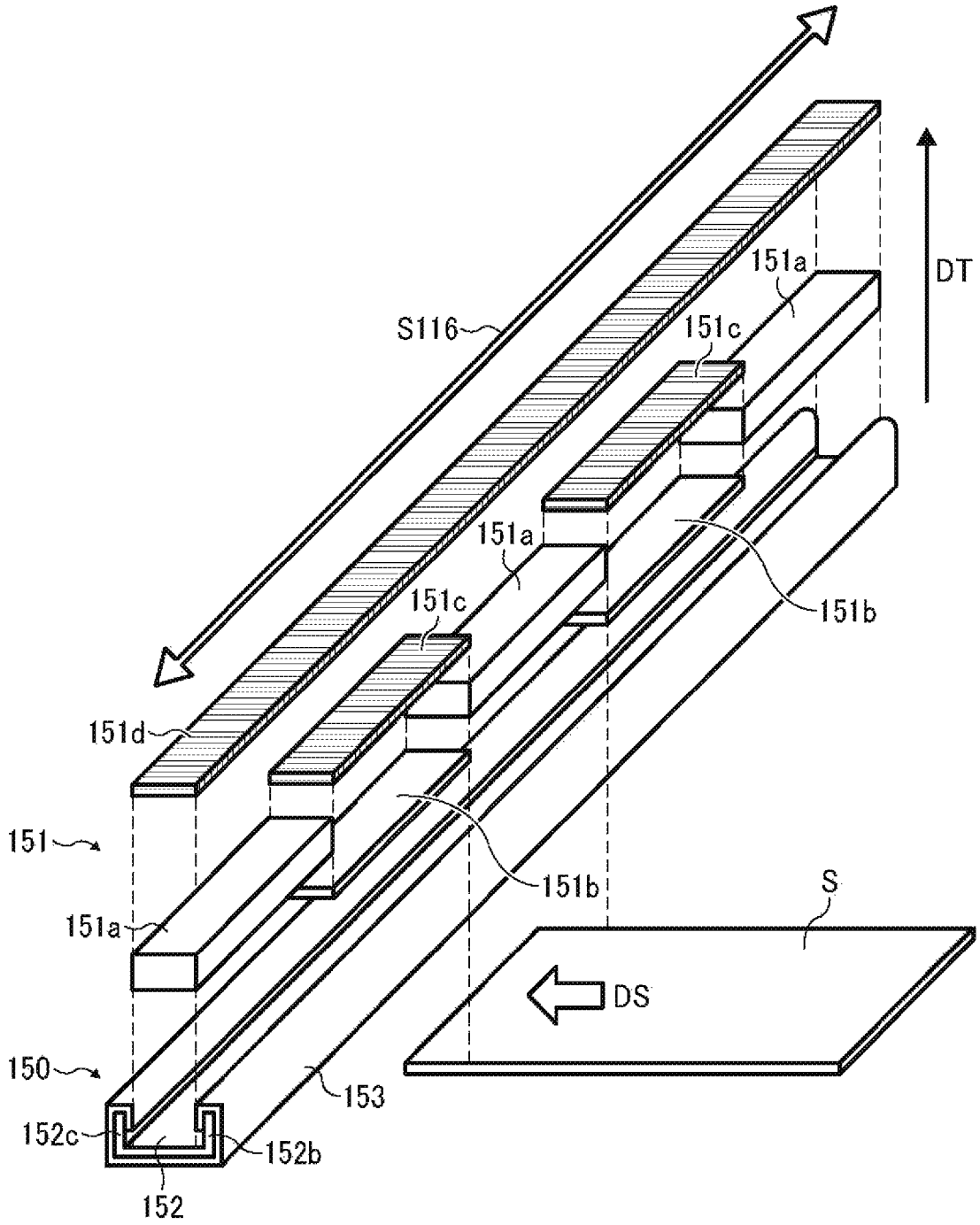
FIG. 3 is an exploded perspective view of a nip formation pad incorporated in the fixing device illustrated in FIG. 2.

FIG. 3 is an exploded perspective view of the nip formation pad 150. As illustrated in FIG. 3, the nip formation pad 150 includes the holder 151 and a thermal equalizer 152. The holder 151 includes a primary thermal insulator 151*a*, a secondary thermal insulator 151*b*, a primary thermal absorber 151*c*, and a secondary thermal absorber 151*d*. FIG. 3 illustrates a light emission span S116 of the halogen heater pair 116 in a longitudinal direction of the holder 151 parallel to the axial direction of the fixing belt 104. The holder 151 is mounted on and supported by the stay 120 depicted in FIG. 2.

The primary thermal insulator 151*a* is made of resin, for example, and has a thermal conductivity smaller than that of the thermal equalizer 152. The primary thermal insulator 151*a* extends partially in the longitudinal direction of the holder 151. For example, the primary thermal insulator 151*a* is disposed at three spans, that is, a center span and both lateral end spans, in the longitudinal direction of the holder 151. The primary thermal insulator 151*a* is sandwiched between the thermal equalizer 152 and the secondary thermal absorber 151*d* and does not overlap the primary thermal absorber 151*c* in the longitudinal direction of the holder 151. A width of the center, primary thermal insulator 151*a* in the longitudinal direction of the holder 151 corresponds to a width of an A6 size sheet S. The primary thermal insulator 151*a* that partially spans in the longitudinal direction of the holder 151 at the three spans does not absorb heat from the fixing belt 104 excessively. Accordingly, the fixing belt 104 is immune from temperature decrease in a conveyance span of the fixing belt 104 where the sheet S is conveyed over the fixing belt 104. Consequently, the fixing device 100 incorporating the fixing belt 104 and the holder 151 shortens a warm-up time and decreases power consumption. The warm-up time defines a time taken to warm up the fixing device 100 from an ambient temperature to a predetermined temperature (e.g., a reload temperature) at which printing is available after the image forming apparatus 1 is powered on.

The secondary thermal insulator 151*b* is made of resin, for example, and has a thermal conductivity smaller than that of the thermal equalizer 152. The secondary thermal insulator 151*b* is sandwiched between the thermal equalizer 152 and the primary thermal absorber 151*c*. The secondary thermal insulator 151*b* reduces an amount of heat conducted from the thermal equalizer 152 to the secondary thermal absorber 151*d* through the primary thermal absorber 151*c*.

If the secondary thermal insulator 151*b* is thick excessively, the thick secondary thermal insulator 151*b* may prohibit heat stored in the fixing belt 104 from being conducted to the secondary thermal absorber 151*d*, rendering the fixing belt 104 to be susceptible to overheating or temperature increase of a non-conveyance span produced at both lateral ends of the fixing belt 104 in the axial direction thereof where the sheet S is not conveyed over the fixing belt 104. It is requested to determine the thickness and the width of the secondary thermal insulator 151*b* based on the degree of overheating or temperature increase of the non-conveyance span of the fixing belt 104. For example, the thickness of the secondary thermal insulator 151*b* is smaller than that of the primary thermal insulator 151*a*.

The secondary thermal absorber 151*d* is made of a material having a thermal conductivity greater than that of the primary thermal insulator 151*a* and the secondary thermal insulator 151*b*. The secondary thermal absorber 151*d* extends entirely in the longitudinal direction of the holder 51 that is parallel to the axial direction of the fixing belt 104. The secondary thermal absorber 151*d* contacts the primary thermal insulator 151*a* and the primary thermal absorber 151*c*.

The primary thermal absorber 151*c* is made of a material having a thermal conductivity greater than that of the primary thermal insulator 151*a* and the secondary thermal insulator 151*b*. The primary thermal absorber 151*c* extends partially in the longitudinal direction of the holder 51 that is parallel to the axial direction of the fixing belt 104. The primary thermal absorber 151*c* is sandwiched between the secondary thermal insulator 151*b* and the secondary thermal absorber 151*d*. The primary thermal absorber 151*c* is disposed outboard from a center span of the fixing belt 104 in the axial direction thereof and disposed opposite the non-conveyance span of the fixing belt 104 where the fixing belt 104 is susceptible to overheating or temperature increase.

The thermal equalizer 152 facilitates conduction of heat in a longitudinal direction thereof parallel to the axial direction of the fixing belt 104, equalizing an amount of heat stored in the fixing belt 104 and thereby suppressing overheating or temperature increase of the non-conveyance span of the fixing belt 104. Conversely, the primary thermal absorber 151*c* and the secondary thermal absorber 151*d* facilitate conduction of heat in a thickness direction DT of the holder 151 perpendicular to the longitudinal direction thereof and absorb heat from the thermal equalizer 152. That is, the primary thermal absorber 151*c* and the secondary thermal absorber 151*d* supplement shortage of thermal capacity of the thermal equalizer 152. For example, the secondary thermal absorber 151*d* has an increased thermal capacity or an increased surface area to increase heat dissipation.

The thermal equalizer 152 is disposed opposite the fixing belt 104 via the slide sheet 153. The thermal equalizer 152 includes an upstream arm 152*b* and a downstream arm 152*c* (e.g., bent portions) disposed at an upstream end and a downstream end of the thermal equalizer 152 in the sheet conveyance direction DS, respectively. The holder 151 and the upstream arm 152*b* and the downstream arm 152*c* of the thermal equalizer 152 sandwich the slide sheet 153 at an upstream portion and a downstream portion of the slide sheet 153 in a slide direction identical to the sheet conveyance direction DS in which the fixing belt 104 slides over the slide sheet 153, thus securing the slide sheet 153 to the nip formation pad 150 precisely. Accordingly, the fixing belt 104 is immune from temperature decrease in the conveyance span of the fixing belt 104 where the sheet S is conveyed over the fixing belt 104. Consequently, the fixing device 100 shortens the warm-up time and decreases power consumption.

The location of the primary thermal absorber 151*c* is not limited to the positions of the primary thermal absorber 151*c* illustrated in FIG. 3. For example, if overheating or temperature increase of the non-conveyance span of the fixing belt 104 that may not be overcome by the thermal equalizer 152 occurs at a plurality of spots spaced apart from each other, the primary thermal absorber 151*c* may be disposed opposite the plurality of overheated spots on the fixing belt 104. In this case, the thickness and the width of the secondary thermal insulator 151*b* are determined based on the degree of overheating or temperature increase at the respective overheated spots in the non-conveyance span of the fixing belt 104. A combined thickness combining the thickness of the primary thermal absorber 151*c* and the thickness of the secondary thermal insulator 151*b* is substantially equivalent to the thickness of the primary thermal insulator 151*a*. Accordingly, the secondary thermal absorber 151*d* comes into surface contact with the primary thermal absorber 151*c*, facilitating conduction of heat between the secondary thermal absorber 151*d* and the primary thermal absorber 151*c*.

The upstream arm 152*b* and the downstream arm 152*c* of the thermal equalizer 152 facilitate installation of the primary thermal insulator 151*a*, the secondary thermal insulator 151*b*, the primary thermal absorber 151*c*, and the secondary thermal absorber 151*d* on the thermal equalizer 152. The thermal equalizer 152 accommodates the primary thermal insulator 151*a*, the secondary thermal insulator 151*b*, the primary thermal absorber 151*c*, and the secondary thermal absorber 151*d* precisely. Alternatively, a projection may project from an inner face, that is, an upper face in FIG. 3, of the thermal equalizer 152 to engage a through-hole produced in each of the primary thermal insulator 151*a*, the secondary thermal insulator 151*b*, the secondary thermal absorber 151*d*, and the like.

A description is provided of a construction of a comparative fixing device incorporating a fixing belt.

The comparative fixing device is requested to facilitate smooth rotation of the fixing belt so as to prevent a sheet conveyed through a fixing nip formed between the fixing belt and a pressure roller from being jammed between the fixing belt and the pressure roller. To address this request, the comparative fixing device includes a slide sheet containing a lubricant that is sandwiched between the fixing belt and a nip formation pad.

The slide sheet is a fabric made of a heat resistant, twisted fiber that generates a decreased friction and facilitates separation of the fixing belt from the slide sheet. For example, the fiber is made of PFA, PTFE, or the like. The slide sheet includes a pressed face that receives pressure from the pressure roller and a non-pressed face that does not receive pressure from the pressure roller. The pressed face has a diagonal twill line directed opposite a diagonal twill line of the non-pressed face to prevent the lubricant from leaking from one end of the slide sheet in an axial direction of the fixing belt through a gutter created on the slide sheet along the twill line.

However, the slide sheet in which the diagonal twill line on the pressed face is directed opposite the diagonal twill line on the non-pressed face abutting the pressed face is manufactured at increased costs. Additionally, since the diagonal twill line is open at both lateral ends of the pressed face and the non-pressed face, even if the diagonal twill line on the pressed face is directed opposite the diagonal twill line on the non-pressed face, the lubricant may leak from both lateral ends of the pressed face and the non-pressed face slightly. Alternatively, the lubricant may have an increased viscosity to prevent leakage from the slide sheet. However, the lubricant may increase a torque that rotates the fixing belt at a slide portion of the fixing belt that slides over the slide sheet, increasing a load imposed to the comparative fixing device.

Alternatively, the slide sheet may be a fabric produced by a plain weave. A direction of a texture of the slide sheet is identical to a rotation direction of the fixing belt. Since a gutter created by the texture of the slide sheet is parallel to the rotation direction of the fixing belt, the lubricant does not leak from both lateral ends of the slide sheet. However, the plain weave is disadvantageous in fiber strength and basis weight compared to a twill weave, degrading strength and durability against abrasion of the slide sheet.

A detailed description is now given of a configuration of the slide sheet 153.

As illustrated in FIG. 2, the slide sheet 153 is wound around the nip formation pad 150 and fixedly secured to the nip formation pad 150 with a metal fitting. The slide sheet 153 is a fabric or a cloth made of a heat resistant, twisted fiber that generates a decreased friction and facilitates separation of the fixing belt 104 from the slide sheet 153. For example, the fiber is made of PFA, PTFE, or the like. As the fixing belt 104 moves over the lubricant circulator 154 impregnated with the lubricant such as silicone oil, the fixing belt 104 receives the lubricant from the lubricant circulator 154. As the fixing belt 104 moves over the slide sheet 153, the lubricant applied to the fixing belt 104 moves to a surface of the slide sheet 153.

Figure 4:
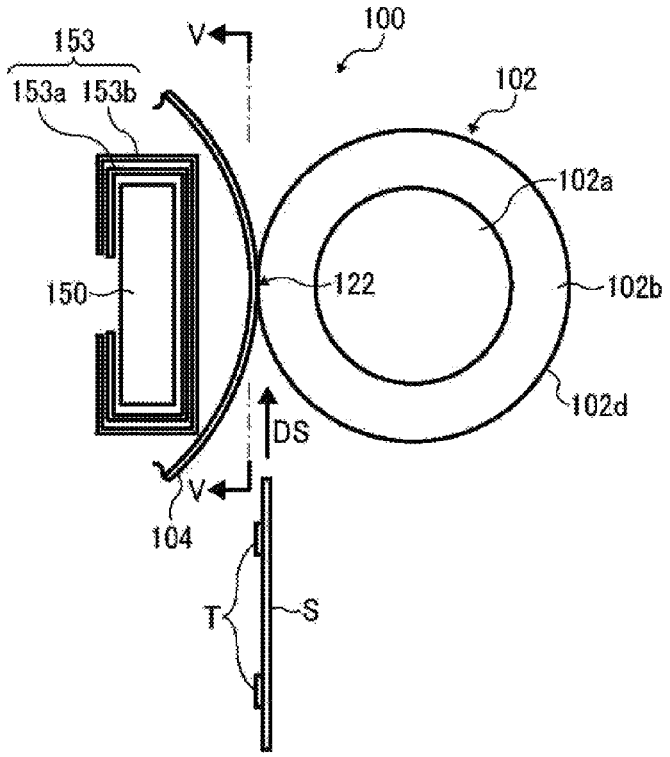
FIG. 4 is a partial vertical cross-sectional view of the fixing device illustrated in FIG. 2.

FIG. 4 is a partial vertical cross-sectional view of the fixing device 100. As illustrated in FIG. 4, the slide sheet 153 has a double-layer structure constructed of a first sheet 153*a* serving as an under-layer and a second sheet 153*b* serving as an upper layer. The slide sheet 153 is a fibrous fabric or cloth. For example, the slide sheet 153 is a twilled woven fabric. Since the twilled woven fabric has a fiber strength and a basis weight (e.g., a density) that are greater than those of a plain-woven fabric, the twilled woven fabric is appropriate for the slide sheet 153 requested to achieve an increased strength and an increased durability against abrasion.

In a twill weave, each weft yarn floats across warp yarns in a progression of interlacing to the right or left, forming a distinct diagonal line defined by a gutter (e.g., a recess) and a ridge (e.g., a projection) on a surface of a fabric macroscopically. Accordingly, if the slide sheet 153 is constructed of a single sheet, the diagonal gutters on the surface of the fabric direct the lubricant rightward or leftward unevenly. Consequently, the lubricant may leak from a right end or a left end of the slide sheet 153.

Figure 5:
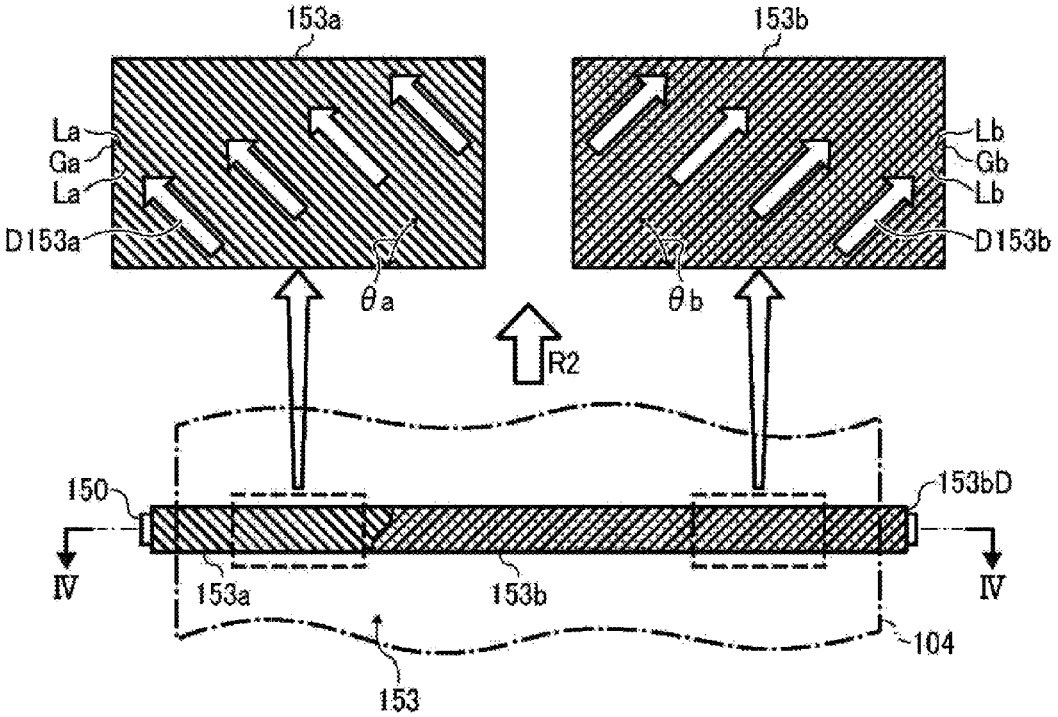
FIG. 5 is a plan view of a first sheet and a second sheet of a slide sheet incorporated in the fixing device illustrated in FIG. 4.

To address this circumstance, the slide sheet 153 according to this exemplary embodiment has the double-layer structure in which the diagonal line on the first sheet 153*a* crosses the diagonal line on the second sheet 153*b*. FIG. 5 is a plan view of the first sheet 153*a* and the second sheet 153*b* seen in a direction V in FIG. 4. As illustrated in FIG. 5, the first sheet 153*a* has diagonal, first twill lines La (e.g., diagonal wales) each of which defines a gutter Ga and a ridge created by weaving and is directed left upward in FIG. 5 in a first direction D153*a*. Conversely, the second sheet 153*b* has diagonal, second twill lines Lb (e.g., diagonal wales) each of which defines a gutter Gb and a ridge created by weaving and is directed right upward in FIG. 5 in a second direction D153*b*. FIG. 5 illustrates the left first sheet 153*a* serving as the under-layer by removing a part of the second sheet 153*b* serving as the upper layer.

For example, a first inclination angle θa is defined by the diagonal wale of the first sheet 153*a*, that is, the first twill line La, relative to a direction perpendicular to the rotation direction R2 of the fixing belt 104. A second inclination angle θb is defined by the diagonal wale of the second sheet 153*b*, that is, the second twill line Lb, relative to the direction perpendicular to the rotation direction R2 of the fixing belt 104. Each of the first inclination angle θa and the second inclination angle θb is 45 degrees. Alternatively, each of the first inclination angle θa and the second inclination angle θb is not limited to 45 degrees and varies depending on a pattern of the twill weave. The diagonal, first twill line La on the first sheet 153*a* crossing the diagonal, second twill line Lb on the second sheet 153*b* offsets or reduces motion of the lubricant directed rightward or leftward, that is, to one lateral end or another lateral end of the slide sheet 153 in the axial direction of the fixing belt 104. Motion of the lubricant along the first twill line La of the first sheet 153*a* and the second twill line Lb of the second sheet 153*b* is entirely or partially converted into motion of the lubricant along the rotation direction R2 of the fixing belt 104 that crosses the first twill line La of the first sheet 153*a* and the second twill line Lb of the second sheet 153*b*.

The first direction D153*a* and the second direction D153*b* illustrating a direction of the first twill line La and a direction of the second twill line Lb, respectively, in FIG. 5 indicate a force exerted to the lubricant moving in the rotation direction R2 of the fixing belt 104 diagonally downstream and therefore do not indicate that the lubricant moves in the first direction D153*a* and the second direction D153*b* practically. The lubricant moving in accordance with rotation of the fixing belt 104 is on the second sheet 153*b* mainly. The first sheet 153*a* placed under the second sheet 153*b* retains a slight amount of the lubricant moving from the second sheet 153*b* and infiltrating the first sheet 153*a* by capillarity. Hence, the first direction D153*a* on the first sheet 153*a* indicates the force exerted to the lubricant on the second sheet 153*b* diagonally downstream. The two forces exerted in opposite directions, respectively, counteract each other. That is, the force exerted diagonally leftward and downstream in the first direction D153*a* counteracts the force exerted diagonally rightward and downstream in the second direction D153*b*, thus moving the lubricant on the second sheet 153*b* in the rotation direction R2 of the fixing belt 104.

Accordingly, the lubricant does not flow unevenly rightward or leftward and therefore does not leak from the right end or the left end of the slide sheet 153, that is, one lateral end or another lateral end of the slide sheet 153 in the axial direction of the fixing belt 104. For example, the lubricant infiltrates the entire second sheet 153*b* of the slide sheet 153 evenly by capillarity and is retained by the second sheet 153*b*, improving retention of the lubricant by the slide sheet 153. Consequently, the fixing device 100 and the image forming apparatus 1 incorporating the fixing device 100 facilitate sliding of the fixing belt 104 over the slide sheet 153 for an extended period of time, improving the life of the fixing belt 104.

In order to allow the force exerted in the first direction D153*a* that moves the lubricant leftward in FIG. 5 to counteract the force exerted in the second direction D153*b* that moves the lubricant rightward effectively, the first inclination angle θa may be equal to the second inclination angle θb and angled in a direction opposite a direction of the second inclination angle θb. However, the second gutters Gb on the second sheet 153*b* in direct contact with the fixing belt 104 move the lubricant dominantly. To address this circumstance, the first inclination angle θa is adjusted to be smaller than the second inclination angle θb, for example, to balance flow of the lubricant between right and left.

If the slide sheet 153 is constructed of a single sheet, the whole slide sheet 153 is replaced with new one when the slide sheet 153 suffers from abrasion. However, with the slide sheet 153 constructed of the first sheet 153*a* and the second sheet 153*b* layered on the first sheet 153*a*, the second sheet 153*b* that suffers from abrasion is replaced with new one. Accordingly, a combination of a material of the first sheet 153*a* and a material of the second sheet 153*b* is adjusted to reduce replacement costs of the slide sheet 153.

For example, although the first sheet 153*a* placed under the second sheet 153*b* contacts the nip formation pad 150, the first sheet 153*a* does not contact the fixing belt 104. Hence, the first sheet 153*a* is requested to achieve resistance against heat and oil mainly. Conversely, since the fixing belt 104 slides over the second sheet 153*b*, the second sheet 153*b* is requested to achieve a decreased friction in addition to resistance against heat and oil mainly.

Accordingly, in view of manufacturing costs, the second sheet 153*b* over which the fixing belt 104 slides is a heat resistant, woven fabric made of fluoro resin, such as aramid fiber, PPS fiber, and nylon fiber, to achieve resistance against heat and oil and the decreased friction.

Conversely, the first sheet 153*a* not contacting the fixing belt 104 directly is a woven fabric made of non-fluoro resin fiber of aramid, PPS, or nylon. Generally, those materials are available at reduced costs compared to fluoro resin. Thus, the slide sheet 153 is produced with the woven fabric made of those fibers at reduced manufacturing costs.

A description is provided of a construction of a slide sheet 153S constructed of a single folded sheet.

As described above, the slide sheet 153 depicted in FIG. 5 is constructed of two separate sheets, that is, the first sheet 153*a* and the second sheet 153*b*, to reduce replacement costs. Alternatively, a single sheet may be folded in two into a first sheet 153*a*S and a second sheet 153*b*S to attain another advantage as illustrated in FIG. 6.

Figure 6:
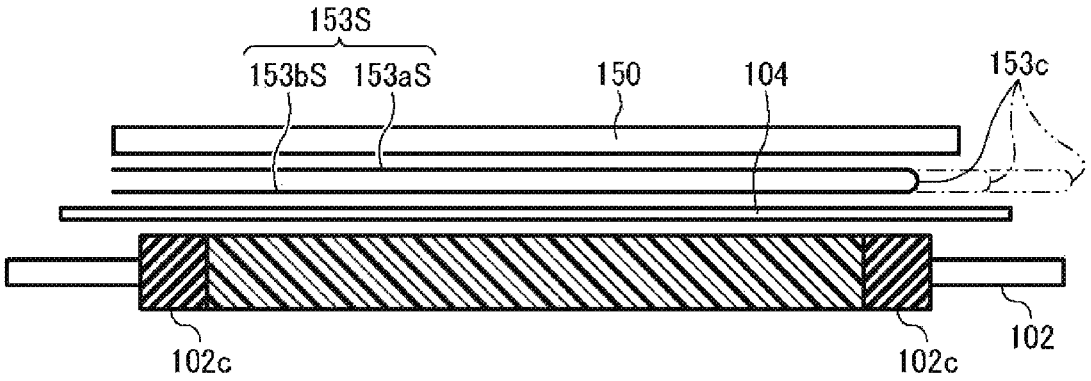
FIG. 6 is a cross-sectional view of a slide sheet as a variation of the slide sheet illustrated in FIG. 5.

FIG. 6 is a cross-sectional view of the slide sheet 153S seen in a direction V-V in FIG. 5. As illustrated in FIG. 6, the single slide sheet 153S is folded in two into the upper, first sheet 153*a*S serving as an under-layer and the lower, second sheet 153*b*S serving as an upper layer. The slide sheet 153S further includes a folded portion 153*c* disposed at one end (e.g., a right end or a left end) of the slide sheet 153S in a longitudinal direction thereof parallel to the axial direction of the fixing belt 104. The folded portion 153*c* bridges the first sheet 153*a*S and the second sheet 153*b*S at one lateral end of the slide sheet 153 in the axial direction of the fixing belt 104 to constitute a single sheet so as to reduce the number of parts of the slide sheet 153S and initial manufacturing costs compared to the slide sheet 153 constructed of the first sheet 153*a* and the second sheet 153*b* constituting two separate sheets, respectively. Additionally, inclination of the first twill line La on the first sheet 153*a*S is symmetrical with inclination of the second twill line Lb on the second sheet 153*b*S with respect to the rotation direction R2 of the fixing belt 104, readily attaining a balance in flow of the lubricant between right and left, that is, both lateral ends of the slide sheet 153S in the longitudinal direction thereof parallel to the axial direction of the fixing belt 104.

The folded portion 153*c* of the slide sheet 153S is selectively placed at three positions (1), (2), and (3) described below to attain different advantages. At each of the positions (1), (2), and (3), the folded portion 153*c* adjoins a downstream side 153*b*D depicted in FIG. 5 of the second sheet 153*b*S substantially in the second direction D153*b*. At the downstream side 153*b*D of the second sheet 153*b*S, the folded portion 153*c* receives the lubricant moving through the second gutter Gb extending along the second twill line Lb on the second sheet 153*b*S. Since a thickness of the folded portion 153*c* is greater than a thickness of other portions of the slide sheet 153S, the folded portion 153*c* is used as a dam or a barrier that blocks flow of the lubricant. The folded portion 153*c* serving as the dam or the barrier prevents leakage of the lubricant from one lateral end or another lateral end of the slide sheet 153S in the longitudinal direction thereof.

A detailed description is now given of placement of the folded portion 153*c* at the position (1).

As illustrated in a solid line in FIG. 6, the folded portion 153*c* is disposed opposite a grip portion 102*c* of the pressure roller 102.

A detailed description is now given of a configuration of the grip portion 102*c* of the pressure roller 102.

The grip portion 102*c* is disposed on each lateral end span of the pressure roller 102 in an axial direction thereof, that is, a non-conveyance span of the pressure roller 102 where the sheet S is not conveyed over the pressure roller 102. The grip portion 102*c* has an increased friction coefficient to drive and rotate the fixing belt 104 supplementarily. For example, the grip portion 102*c* is made of heat resistant foam such as silicone rubber foam and fluoro rubber foam. The grip portion 102*c* having the increased friction coefficient, as the grip portion 102*c* is pressed against the fixing belt 104, grips the fixing belt 104 sufficiently, driving and rotating the fixing belt 104 stably in accordance with rotation of the pressure roller 102.

The grip portion 102*c* has a decreased epaxial hardness compared to the release layer 102*d* depicted in FIG. 2 made of PFA or PTFE to achieve the increased friction coefficient and exert decreased pressure to the sheet S conveyed through the fixing nip 122. To address this circumstance, the folded portion 153*c* of the slide sheet 153S is disposed opposite the grip portion 102*c*, preventing damage to the folded portion 153*c* and stabilizing motion of the fixing belt 104.

As described above, the thickness of the folded portion 153*c* is greater than the thickness of other portions of the slide sheet 153S. Accordingly, the folded portion 153*c* may receive a local stress from the pressure roller 102. Similarly, the fixing belt 104 may receive a local stress from the pressure roller 102 and therefore may move unstably in the axial direction of the fixing belt 104.

To address this circumstance, the folded portion 153*c* is disposed opposite the grip portion 201*c* of the pressure roller 102. The grip portion 102*c* has the decreased epaxial hardness compared to other portions of the pressure roller 102 and exerts decreased pressure to the sheet S conveyed through the fixing nip 122. To address this circumstance, the folded portion 153*c* is disposed opposite the grip portion 102*c*, reducing the local stress exerted from the pressure roller 102 to the folded portion 153*c* and the fixing belt 104, preventing damage to the folded portion 153*c*, achieving the extended life of the slide sheet 153S, and stabilizing motion of the fixing belt 104.

A detailed description is now given of placement of the folded portion 153*c* at the position (2).

As illustrated in a dashed line in FIG. 6, the folded portion 153*c* is disposed outboard from the nip formation pad 150 in a longitudinal direction thereof parallel to the axial direction of the fixing belt 104 and disposed opposite the fixing belt 104.

As described above, the thickness of the folded portion 153*c* is greater than the thickness of other portions of the slide sheet 153S. If the folded portion 153*c* is disposed opposite the fixing belt 104, the thick folded portion 153*c* lifts the fixing belt 104, degrading stable motion of the fixing belt 104 throughout the entire axial span of the fixing belt 104. To address this circumstance, the folded portion 153*c* is disposed outboard from the nip formation pad 150 in the longitudinal direction thereof and disposed opposite the fixing belt 104 at an outboard span that is outboard from the pressure roller 102 in the axial direction thereof. Accordingly, the pressure roller 102 does not press the fixing belt 104 against the folded portion 153*c* directly, preventing the fixing belt 104 from being exerted with the local stress. In other words, the folded portion 153*c* is disposed opposite a non-pressurization span in the axial direction of the fixing belt 104 where the folded portion 153*c* does not receive pressure from the pressure roller 102.

A detailed description is now given of placement of the folded portion 153*c* at the position (3).

As illustrated in a long dashed double-short dashed line in FIG. 6, the folded portion 153*c* is disposed outboard from the fixing belt 104 in the axial direction thereof.

As described above, since the thickness of the folded portion 153*c* is greater than the thickness of other portions of the slide sheet 153S, the folded portion 153*c* changes motion of the fixing belt 104, degrading stable motion of the fixing belt 104 throughout the entire axial span of the fixing belt 104. To address this circumstance, the folded portion 153*c* is disposed outboard from the fixing belt 104 in the axial direction thereof. In other words, the folded portion 153*c* is disposed opposite the non-pressurization span in the axial direction of the fixing belt 104 where the folded portion 153*c* does not receive pressure from the pressure roller 102. Accordingly, the above-described disadvantageous circumstance is overcome.

Figure 7:
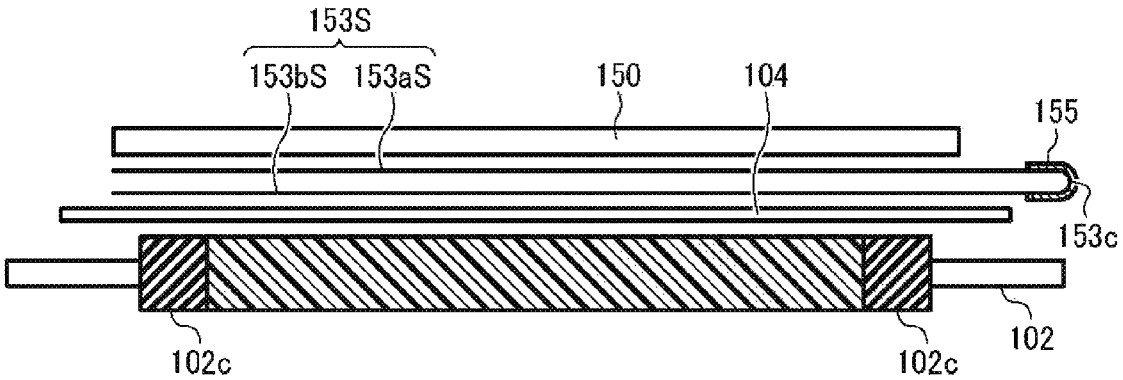
FIG. 7 is a cross-sectional view of the slide sheet depicted in FIG. 6 illustrating a lubricant absorber mounted thereon.

The folded portion 153*c* may mount a lubricant absorber 155 made of heat resistant felt or the like as illustrated in FIG. 7. FIG. 7 is a cross-sectional view of the slide sheet 153S illustrating the lubricant absorber 155. The lubricant absorber 155 is replaceable. The lubricant absorber 155 receives the lubricant leaked from one lateral end of the fixing belt 104 in the axial direction thereof precisely, preventing the lubricant from dropping onto and staining peripherals of the fixing device 100. If the lubricant absorber 155 is disposed outboard from the fixing belt 104 in the axial direction thereof, the lubricant absorber 155 is separable from the slide sheet 153S readily for replacement with new one.

The construction and the configuration of the fixing device 100 are not limited to those of the exemplary embodiments described above. The present disclosure is not limited to the details of the exemplary embodiments described above and various modifications and improvements are possible.

A description is provided of advantages of the fixing device 100.

As illustrated in FIG. 2, the fixing device 100 includes an endless belt (e.g., the fixing belt 104) rotatable in a predetermined direction of rotation (e.g., the rotation direction R2); a heater (e.g., the halogen heater pair 116) configured to heat the endless belt; a pressure rotator (e.g., the pressure roller 102) to press against an outer circumferential surface of the endless belt to form the fixing nip 122 therebetween; a nip formation pad (e.g., the nip formation pad 150) disposed opposite an inner circumferential surface of the endless belt and disposed opposite the pressure rotator via the endless belt to form the fixing nip 122 between the endless belt and the pressure rotator, through which a recording medium (e.g., a sheet S) bearing a toner image (e.g., a toner image T) is conveyed; and a slide sheet (e.g., the slide sheets 153 and 153S) sandwiched between the nip formation pad and the endless belt. The slide sheet includes a twill fabric containing a lubricant and woven by a twill weave.

As illustrated in FIGS. 5 and 6, the slide sheet includes a first sheet (e.g., the first sheets 153*a* and 153*a*S) contacting the nip formation pad and a second sheet (e.g., the second sheets 153*b* and 153*b*S) layered on the first sheet and contacting the endless belt. The first sheet includes the first gutter Ga defined by the first twill line La in the first direction D153*a* angled relative to the direction of rotation of the endless belt. The second sheet includes the second gutter Gb defined by the second twill line Lb in the second direction D153*b* angled relative to the direction of rotation of the endless belt.

Accordingly, flow of the lubricant in the first direction D153*a* through the first gutter Ga on the first sheet offsets flow of the lubricant in the second direction D153*b* through the second gutter Gb on the second sheet, preventing the lubricant from moving unevenly rightward or leftward, that is, to one lateral end or another lateral end of the slide sheet in an axial direction of the endless belt, and therefore preventing the lubricant from leaking from one lateral end or another lateral end of the slide sheet in the axial direction of the endless belt. Consequently, the endless belt slides over the slide sheet smoothly, preventing the torque of a driver (e.g., the pressure roller 102) that drives and rotates the endless belt from increasing and thereby achieving the extended life of the fixing device 100.

For example, the first sheet and the second sheet of the slide sheet prevent the lubricant from leaking from both lateral ends of the slide sheet in the axial direction of the endless belt precisely at reduced costs, preventing the lubricant from staining the peripherals of the fixing device 100 due to leakage of the lubricant and preventing increase in the torque of the pressure rotator. Further, the first sheet and the second sheet achieve a sufficient strength and a sufficient durability against abrasion, extending the life of the slide sheet.

According to the exemplary embodiments described above, the fixing belt 104 serves as an endless belt. Alternatively, a fixing film, a fixing sleeve, or the like may be used as an endless belt. Further, the pressure roller 102 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

an endless belt rotatable in a predetermined direction of rotation;

a nip formation pad disposed opposite an inner circumferential surface of the endless belt;

a pressure rotator to press against the nip formation pad via the endless belt to form a fixing nip between the endless belt and the pressure rotator, the fixing nip through which a recording medium bearing a toner image is conveyed; and a slide sheet sandwiched between the nip formation pad and the endless belt and being a twill fabric containing a lubricant, the slide sheet including:

a first sheet contacting the nip formation pad and including a first gutter defined by a first twill line in a first direction angled relative to the direction of rotation of the endless belt; and a second sheet layered on the first sheet and contacting the endless belt, the second sheet including a second gutter defined by a second twill line in a second direction angled relative to the direction of rotation of the endless belt.

2. The fixing device according to claim 1, wherein the first twill line of the first sheet is symmetrical with the second twill line of the second sheet with respect to the direction of rotation of the endless belt.

3. The fixing device according to claim 1, wherein the slide sheet further includes a folded portion bridging the first sheet and the second sheet.

4. The fixing device according to claim 3, wherein the folded portion of the slide sheet is disposed outboard from the endless belt in an axial direction of the endless belt.

5. The fixing device according to claim 3, wherein the folded portion of the slide sheet is disposed opposite a non-pressurization span in an axial direction of the endless belt where the folded portion does not receive pressure from the pressure rotator.

6. The fixing device according to claim 3, wherein the folded portion of the slide sheet is disposed outboard from the nip formation pad in an axial direction of the endless belt and disposed opposite the endless belt.

7. The fixing device according to claim 3, wherein the pressure rotator includes a grip portion, disposed at a lateral end of the pressure rotator in an axial direction thereof, to drive the endless belt supplementarily.

8. The fixing device according to claim 7, wherein the folded portion of the slide sheet is disposed opposite the grip portion of the pressure rotator.

9. The fixing device according to claim 3, wherein the folded portion of the slide sheet adjoins a downstream side of the second sheet substantially in the second direction.

10. The fixing device according to claim 3, further comprising a lubricant absorber mounted on the folded portion of the slide sheet and being separable from the slide sheet for replacement.

11. The fixing device according to claim 3, wherein the folded portion bridges the first sheet and the second sheet at one lateral end of the slide sheet in an axial direction of the endless belt.

12. The fixing device according to claim 1, wherein the first sheet and the second sheet of the slide sheet are made of different materials, respectively.

13. The fixing device according to claim 12, wherein the first sheet is made of non-fluoro resin fiber.

14. The fixing device according to claim 13, wherein the second sheet is made of heat resistant fluoro resin.

15. The fixing device according to claim 1, wherein the nip formation pad includes:

a thermal equalizer, disposed opposite the endless belt via the slide sheet, to equalize an amount of heat stored in the endless belt in an axial direction of the endless belt; and a holder sandwiching the slide sheet with the thermal equalizer to secure the slide sheet to the nip formation pad.

16. The fixing device according to claim 1, wherein the first twill line has a first inclination angle relative to a direction perpendicular to the direction of rotation of the endless belt and the second twill line has a second inclination angle relative to the direction perpendicular to the direction of rotation of the endless belt.

17. The fixing device according to claim 16, wherein each of the first inclination angle and the second inclination angle is 45 degrees.

18. The fixing device according to claim 16, wherein the first inclination angle is smaller than the second inclination angle.

19. The fixing device according to claim 1, wherein the first sheet is separated from the second sheet.

20. An image forming apparatus comprising:

an image bearer to bear a toner image; and a fixing device disposed downstream from the image bearer in a recording medium conveyance direction to fix the toner image on a recording medium, the fixing device including:

an endless belt rotatable in a predetermined direction of rotation;

a nip formation pad disposed opposite an inner circumferential surface of the endless belt;

a pressure rotator to press against the nip formation pad via the endless belt to form a fixing nip between the endless belt and the pressure rotator, the fixing nip through which the recording medium bearing the toner image is conveyed; and a slide sheet sandwiched between the nip formation pad and the endless belt and being a twill fabric containing a lubricant, the slide sheet including:

a first sheet contacting the nip formation pad and including a first gutter defined by a first twill line in a first direction angled relative to the direction of rotation of the endless belt; and a second sheet layered on the first sheet and contacting the endless belt, the second sheet including a second gutter defined by a second twill line in a second direction angled relative to the direction of rotation of the endless belt.

* * * * *